US005513676A

United States Patent [19]

Speich

[11] Patent Number: 5,513,676

[45] Date of Patent: May 7, 1996

[54] LIFTING KNIFE TYPE SHEDDING DEVICE FOR A WEAVING MACHINE

[75] Inventor: Francisco Speich, Gipf-Oberfrick, Switzerland

[73] Assignee: Tetilma AG, Hergiswil, Switzerland

[21] Appl. No.: 351,335

[22] Filed: Dec. 12, 1994

[30] Foreign Application Priority Data

Apr. 26, 1993 [CH] Switzerland ..... 1257/93

[51] Int. Cl.[6] ..... D03C 3/36; D03C 3/06

[52] U.S. Cl. ..... 139/65; 139/59

[58] Field of Search ..... 139/59, 65, 55.1, 139/66 R, 68

[56] References Cited

U.S. PATENT DOCUMENTS

| | | | |
|---|---|---|---|
| 4,936,352 | 6/1990 | Keim | 139/65 |
| 5,115,838 | 5/1992 | Derudder | 139/65 |
| 5,176,181 | 1/1993 | Bassi | 139/65 |

FOREIGN PATENT DOCUMENTS

| | | | |
|---|---|---|---|
| 0409139 | 7/1990 | European Pat. Off. . | |
| 048891 | 11/1991 | European Pat. Off. . | |
| 1331682 | 5/1963 | France | 139/65 |
| 1535220 | 12/1970 | Germany | 139/59 |
| 3721932 | 4/1990 | Germany . | |
| 4027575 | 2/1992 | Germany | 139/65 |
| 111971 | 11/1924 | Switzerland | 139/65 |
| 433133 | 9/1967 | Switzerland | 139/59 |
| 986770 | 3/1965 | United Kingdom | 139/59 |
| 1032014 | 6/1966 | United Kingdom | 139/59 |
| 2047755 | 4/1979 | United Kingdom | 139/59 |

*Primary Examiner*—Andy Falik
*Attorney, Agent, or Firm*—Anderson Kill Olick & Oshinsky

[57] ABSTRACT

A shedding device for weaving machines including lifting knives arranged on both ends of respective knife units for joint displacement with the knife units up and down in respective mutually opposite direction, with each knife unit being connected to the device frame by a separate lever provided on one side of the knife unit and by a lever arrangement provided on another side of the knife unit, which lever arrangement has a lever and a guide rod that connects this lever with the frame or the knife unit.

9 Claims, 6 Drawing Sheets

LIFTING KNIFE TYPE SHEDDING DEVICE FOR A WEAVING MACHINE

BACKGROUND OF THE INVENTION

1. Field of the Invention

The present invention relates to a shedding device for a weaving machine and including lifting knives movable up and down in mutually opposite directions by crank drives with which the lifting knives are connected by a system of levers.

2. Description of the Prior Art

The object of the invention is a shedding device of the above-described type having a simplified structure and enabling a precise wear-free motion sequence at high speeds, independent of the length of lifting knives and the magnitude of the lifting motions.

SUMMARY OF THE INVENTION

The object of the invention is achieved by arranging the lifting knives on both side of respective knife units movable up and down in mutually opposite directions, with each knife unit being connected to the frame with a lever and a lever arrangement provided, respectively, on opposite sides of the knife unit, with the lever arrangement including a lever and a guide rod which connects this lever with the frame or the knife unit.

Jacquard machine with such a shedding motion arrangement is known from the DE patent publication No. 37 21 932. A two-part lever arrangement is provided for this shedding motion arrangement, wherein the one lever is connected to a driving device and the other lever to a knife unit. The driving device contains an eccentric, on which reversing rollers disposed on a carrier travel. A shaft is fastened to the carrier which shaft performs an oscillating pivotal motion and to which the lever is fastened. The knife unit is guided in a straight line in the middle by means of slide-type guides, in order to prevent pivoting of the knife edge. This slide-type guide affects the functional security and the speed of the weaving machine in a very disadvantageous manner. The advantages achievable by the invention are essentially the following, that

- the knife unit is guided at both ends by means of lever arrangements,
- the arrangement comprises a small quantity of drive elements for the movements of the knife unit, thus reducing the mass,
- thus the displacement of the knife unit occurring during the upward and downward motion of same can be compensated even during a long stroke, and
- that the arrangement can do without slide-type guides, by means of which a motion sequence free of wear and a secure operational behavior is assured at high speeds with the lowest amount of lubrication possible and with a slight noise- and heat-generation.

In a preferred embodiment form the lever of the lever arrangement is articulated or linked to the knife unit and the guiding or controlling device is on the one hand linked to the positionally stable frame and on the other hand is connected to the pivotable lever.

Due to the disposition of the guiding or control device between frame and lever, the dimensions of the arrangement can be advantageously reduced.

It is advantageous if the crank drives are allocated in pairs to a pair of knife units and are arranged on a shaft on both ends of each pair of knife units, in such a way that each pair of knife units can be moved synchronously up and down at the ends and if the crank drive includes a drive crank and a connecting rod. A precise sequence of motion is achieved by this arrangement in an expedient manner.

The lever or the lever arrangement can be connected to the connecting rod through an actuation device, in order to adjust the pivot angle in such a way, that the stroke height of the ends of each pair of knife units can be adjusted either equally, in order to form a parallel shed, or unequally, in order to form a V-shed. The advantage of this arrangement can be seen in that an explicit shed position is achieved at the same time as providing a simple manipulation or handling of the device.

It is further advantageous, if one holder or retainer for the lifting knife is provided, which is connected fixedly to the lifting knife and in an articulated manner to the knife unit and if the lifting knife is at least at the ends guided in a guidance arrangement fixed in the frame.

Herein a precise guidance of the hooks or lifters intercepted by the lifting knives is assured and consequently vibrations or oscillations of the hooks or lifters at a high number of strokes are prevented.

A drive wheel can be fastened to each shaft, which wheels are connected to the drive through a kinematic organ, this in order to move the crank drives synchronously. The advantage of this arrangement is a precise motion sequence while using a minimum of parts.

BRIEF DESCRIPTION OF THE DRAWINGS

The invention is described in the following with the help of the enclosed drawings. It is shown on.

DETAILED DESCRIPTION OF THE PREFERRED EMBODIMENTS

Figure 1:
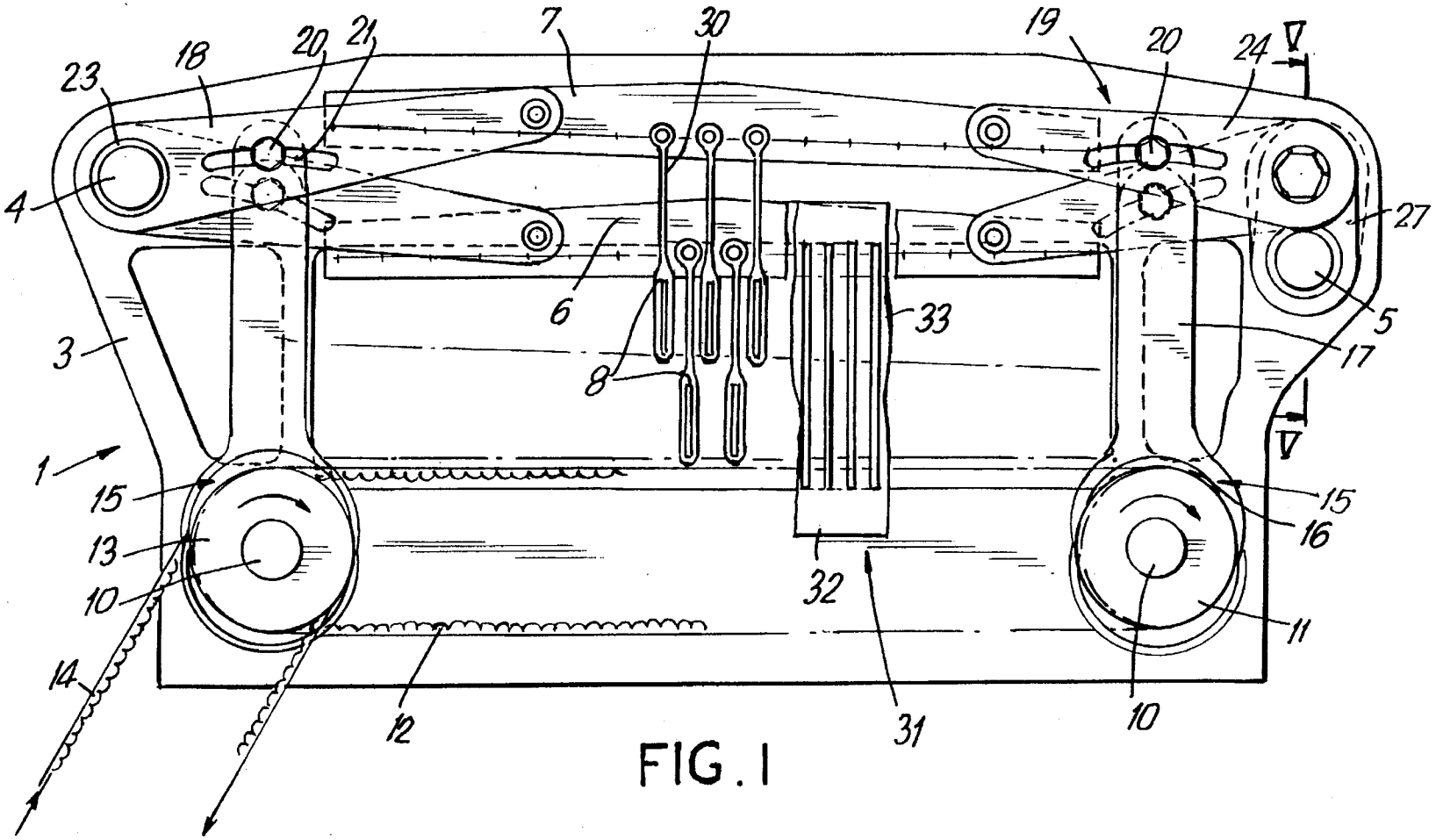
FIG. 1 a side view of an embodiment form of the V-type shedding motion in the invention, FIG. 2 a plan view upon the shedding motion device shown in FIG. 1, FIGS. 3 and 4 a side view of the arrangement in FIG. 1 which shows a knife unit in the upper shed position or the lower shed position, FIG. 5 a section along the line V—V in FIG. 1, FIG. 6 a view of an embodiment form of a lifting knife arrangement of the shedding motion device and FIG. 7 a side view of an additional embodiment form of the shedding motion device in the invention.
Figure 2:
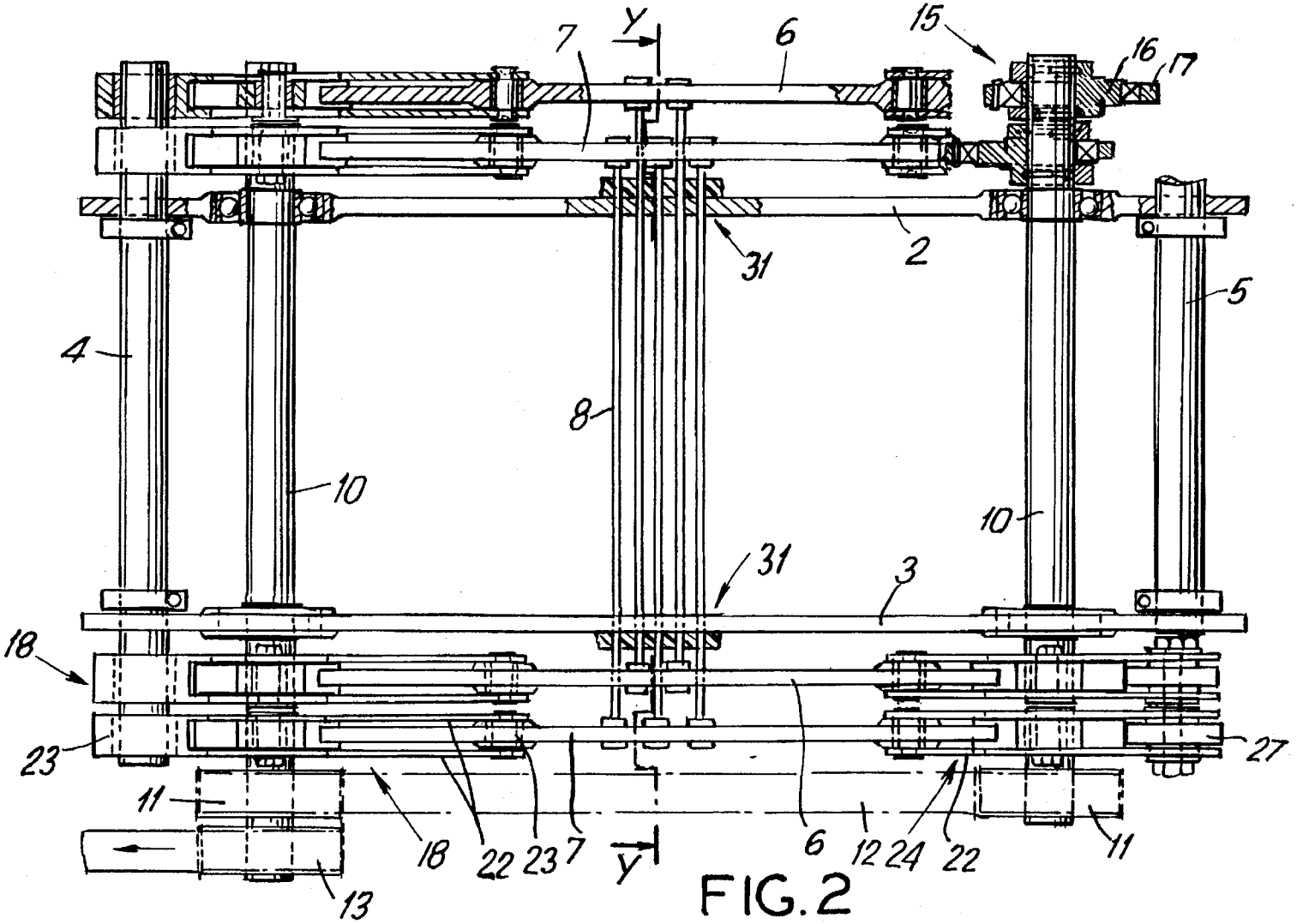

As is shown in FIGS. 1 and 2, the shedding motion device contains a frame 1, comprising two frame shields 2, 3 disposed at a parallel distance to one another and two axes 4, 5 which are connected to the shields so as not to be rotatable with respect to same. Two pairs of knife units 6, 7 are located in the frame, which can be moved in opposite directions up and down between an upper and lower shed position and are respectively connected in an articulated manner with lifting knives 8, so that these can be moved up and down.

Two shafts 10 are rotatably supported in the frame 1, which shafts extend beyond the frame shields 2, 3. One drive wheel 11 respectively is fastened to each shaft 10, which drive wheels 11 are connected with one another by a toothed belt 12. A second drive wheel 13 is fastened on one of the shafts 10, which is connected to a principal drive not shown here by means of an additional toothed belt 14.

Four crank mechanisms 15 are allocated to each pair of knife units, which respectively comprise a drive crank 16 and connecting rod 17 connected therewith. The crank mechanisms are assigned in pairs to one pair of knife units 6, 7 and are disposed on the shaft 10 on both ends of each pair of knife units, so that each pair of knife units is moved synchronously up and down at its ends.

The crank mechanism 15 comprises a drive crank 16 and a connecting 17. The travel surfaces of the drive crank 16 for the one pair of knives are arranged so as to be offset through 180° against the travel surfaces of the drive crank for the other pair of knives, so as in this way to achieve the oppositely directed up and down motion.

Each knife unit 6, 7 is connected at one end with a lever 18 and at the other end with a lever arrangement 19 and in addition to the connecting rod 17 of the crank mechanism. The connecting 17 and the lever 18 or the lever arrangement 19 are rotatably connected by a set- or adjustment-screw 20, which passes through an elongated hole 21 and is displaceable therein, in order to individually adjust the pivot angle of every lever or every lever arrangement and with this also the lifting or stroking excursion of each pair of knife units 6, 7. This arrangement permits to adjust the lifting height at each end of the pair of knife units to be either equal in order to form a parallel shed, or unequal in order to form a V-shed.

The lever 18 consists of two webs 22 extending parallel to each other and two bushes 23 defining the pivot axis of the lever 18. The lever 18 is on the one hand linked to the positionally stable axis 4 and on the other hand to the mobile knife unit.

Figure 3:
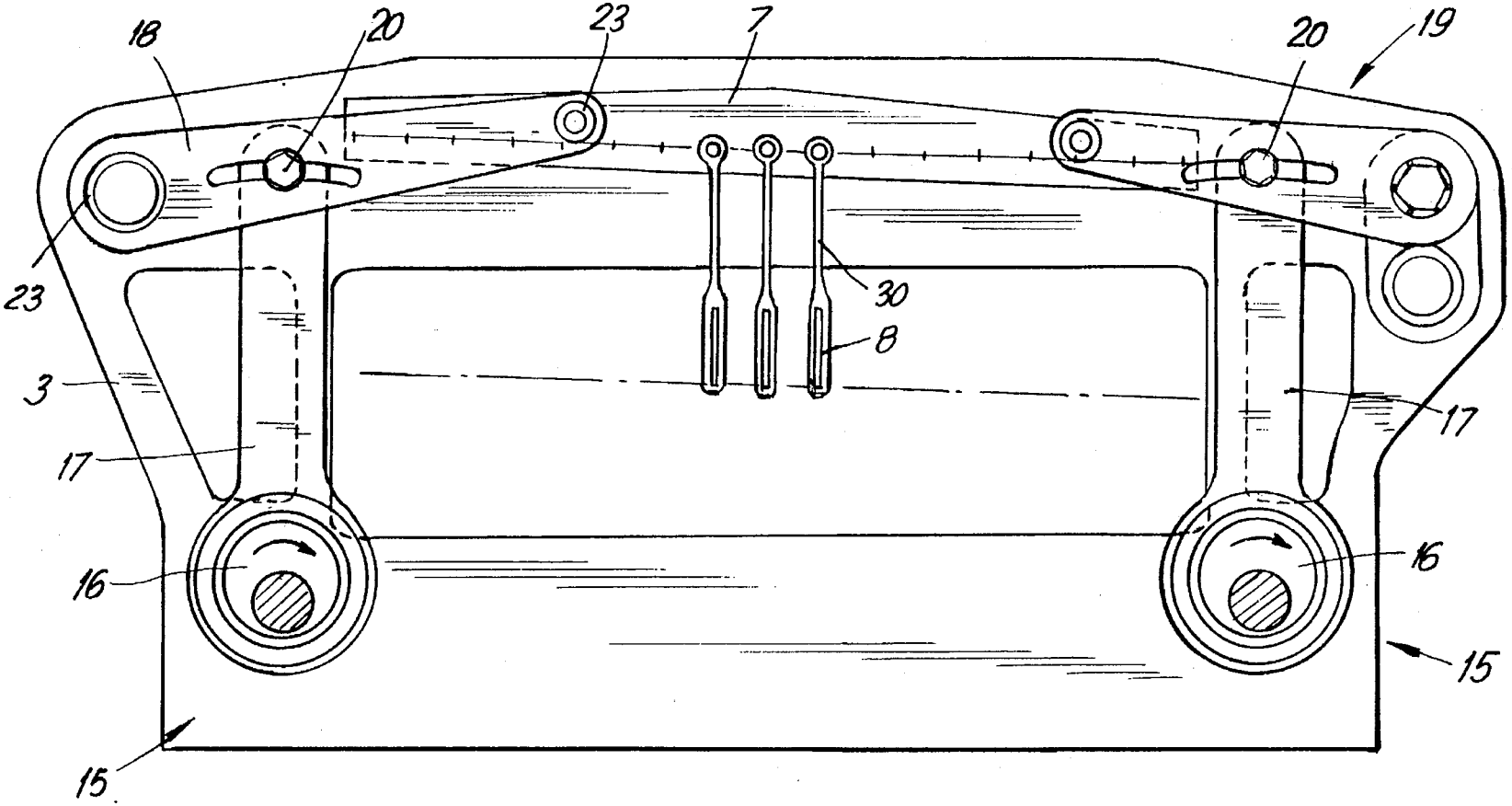
Figure 4:
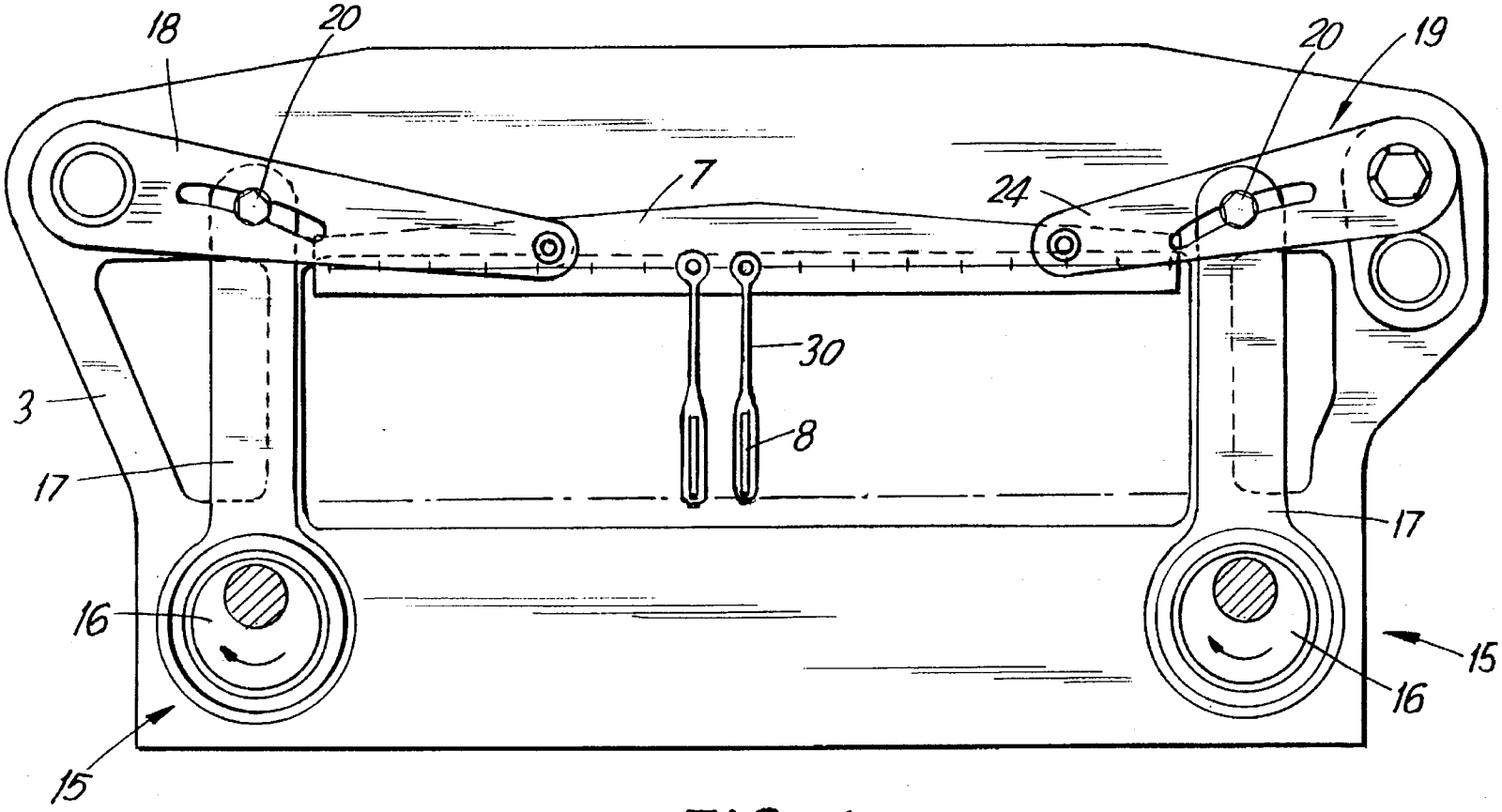

The lever arrangement 19 contains a lever 24 identical to lever 18, with two webs 22 and two bushes 23 and a guiding rod 27. The lever 24 is articulated on one side to the mobile knife bed or bench and on the other side to the pivotable guiding rod 27. The guiding rod 27 is linked at the positionally stable axis 5. The motion displacement which occurs is absorbed by the guiding rod 27. The maximum excursion of the guiding rod is shown in dotted lines. For better understanding respectively the same pair of knife units 7 is shown in FIGS. 3 and 4, indeed in the upper shed position (FIG. 3) and in the lower shed position (FIG. 4). As these Figures, show the spacing between the pivot axes of the lever 18 and the lever 24 are of different lengths and laid out in such a way, that a parallel shed or a V shed can be formed.

Figure 5:
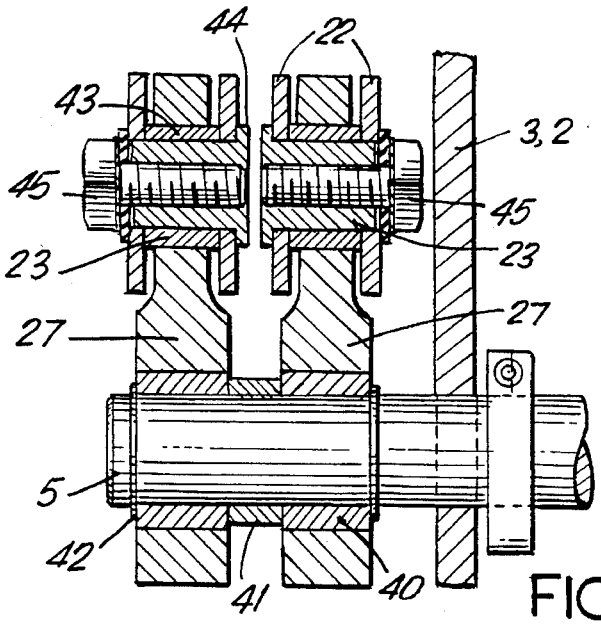

As is shown in FIG. 5, the guiding rods 27 are respectively provided with a bush 40 and are disposed on the fixed shaft 5, so as to be spaced from each other by a spacer sleeve 41, as well as being secured against sideways displacement by disks or washers 42. A bearing bush 43 is provided between the bush 23 and the guiding device 27, which bearing bush keeps at the same time the webs 22 so as to be spaced from each other. The bush 23 has a flank 44 at one end and an internal thread into which a bolt 45 is screwed-in. This bolt 45 fixes the webs 22 on the bush 23.

Figure 6:
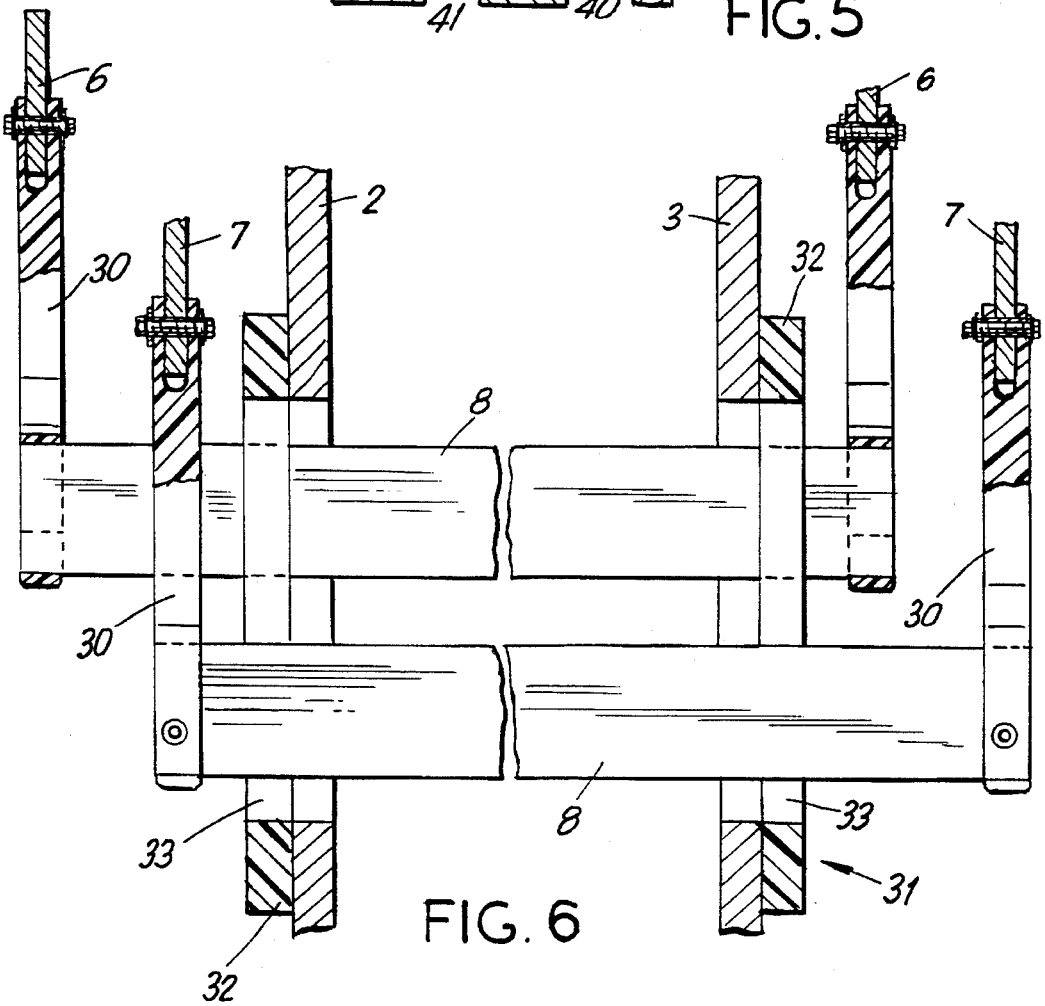

A quantity of lifting knives 8 are allocated to each pair of knife units 6, 7. As is seen in FIGS. 2 and 6, the individual lifting knives are connected to the knife units by retainers or holders 30. The lifting knife 8 is fixedly connected to holder 30 and the holder is linked to the knife unit. Each lifting knife 8 is guided in a guidance device or arrangement 31, so that said knife 8 performs a straight line up and down movement. This prevents an excursion of the hooks (not shown) engageable by the lifting knife 8. The guiding arrangement 31 consists of a plate 32 which is fastened at the outer side of the frame shields 2, 3. Slots 33 are configured in the plate 32, through at least which the ends of the lifting knife 8 extend and are guided during the up and down movement.

Figure 7:
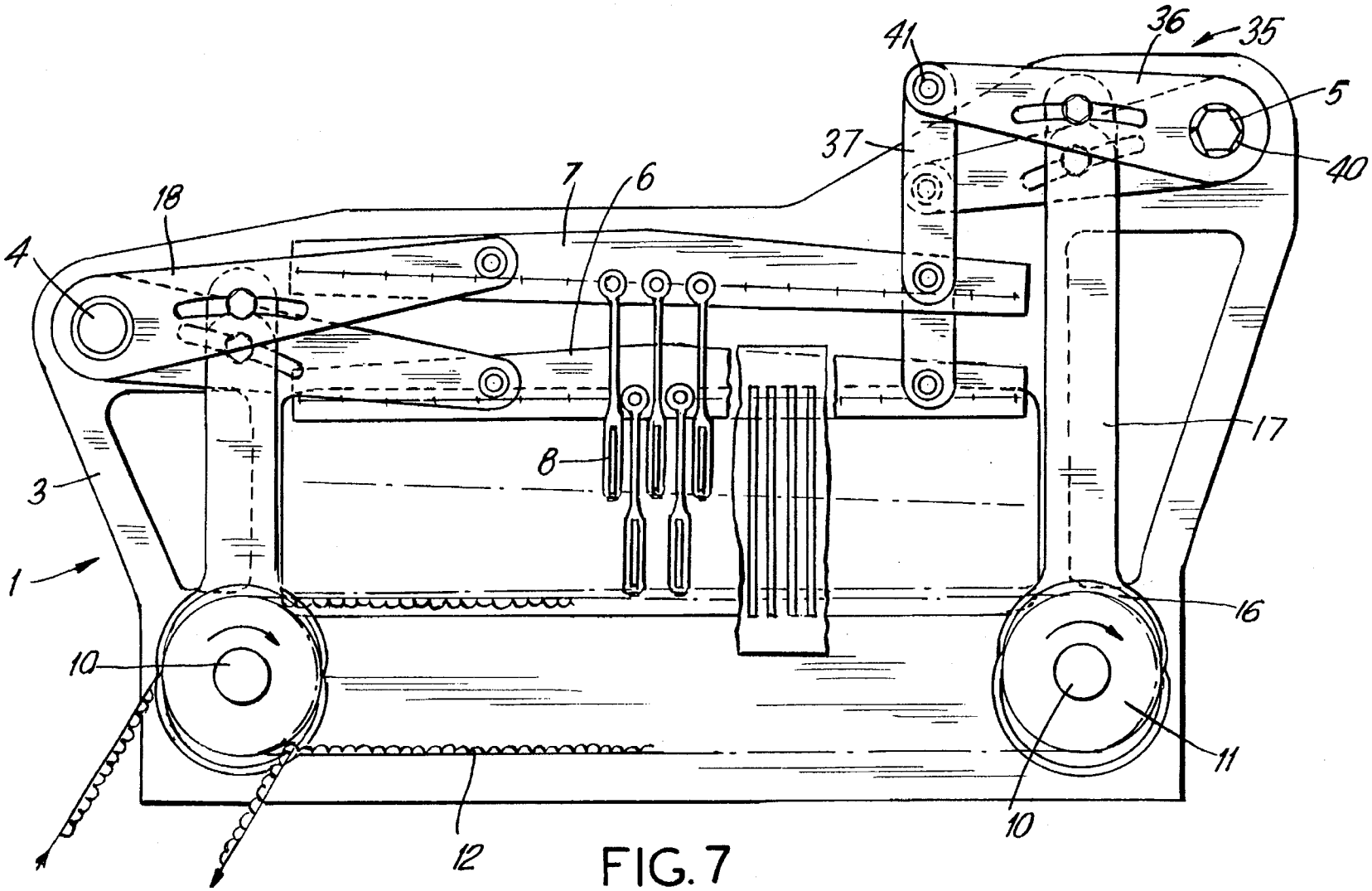

The embodiment form shown in FIG. 7 differs from the shedding motion arrangement described above essentially by the disposition of the levers.

The disposition of the levers 35 contains a lever 36 and a guide rod 37. The lever 36 consists of two webs extending parallel to each other, which are connected at the ends by bushes 40, 41 which define the pivot axis of the lever 36. In this arrangement lever 36 is linked to the positionally stable axis 5, while the guide rod 37 on the one side is linked to the pivotable lever 36 and on the other side to the mobile knife unit.

I claim:

1. A shedding device for weaving machines, comprising:

a frame;

two pairs of knife units supported on the frame and movable up and down in mutually opposite directions;

lifting knives arranged on both ends of respective knife units for joint displacement therewith;

crank mechanisms provided on both ends of the respective knife units for displacing same, together with respective lifting knives;

a separate lever arranged at one side of the knife unit and linked thereto and positively stably linked to the frame; and a lever arrangement arranged at another side of the knife unit, the lever arrangement comprising a lever connected to the knife unit, and a guide rod positively stably connected to the frame at one end thereof and pivotally connected, at another end thereof, to the lever of the lever arrangement.

2. A shedding device for weaving machines, comprising:

a frame;

two pairs of knife units supported on the frame and movable up and down in mutually opposite directions;

lifting knives arranged on both ends of respective knife units for joint displacement therewith;

crank mechanisms provided on both ends of the respective knife units for displacing same, together with respective lifting knives;

a separate lever arranged at one side of the knife unit and linked thereto and positively stably linked to the frame; and a lever arrangement arranged at another side of the knife unit, the lever arrangement comprising a lever and guide rod for connecting the lever of the lever arrangement with one of the frame and the knife unit;

wherein the crank mechanisms are allocated in pair to a pair of knife units and are disposed on shafts at both ends of the pair of knife units, whereby the pair of knife units is synchronously movable up and down at both ends;

wherein each crank mechanism comprises a drive crank and a connecting rod.

3. A shedding device according to claim 2, further comprising adjustment means for connecting the lever of the lever arrangement to the connecting rod for adjusting a pivot angle so that a lifting height of both ends of the knife unit is adjusted equally to thereby form a parallel shed.

4. A shedding device according to claim 2, further comprising adjustment means for connecting the lever of the lever arrangement to the connecting rod for adjusting a pivot angle so that a lifting height of both ends of the knife unit is adjusted unequally to thereby form a V-shed.

5. A shedding device for weaving machines, comprising:

a frame;

two pairs of knife units supported on the frame and movable up and down in mutually opposite directions;

lifting knives arranged on both ends of respective knife units for joint displacement therewith;

crank mechanisms provided on both ends of the respective knife units for displacing same, together with respective lifting knives;

a separate lever arranged at one side of the knife unit and linked thereto and positively stably linked to the frame; and a lever arrangement arranged at another side of the knife unit, the lever arrangement comprising a lever and a guide rod for connecting the lever of the lever arrangement with one of the frame and the knife unit; and retainers linked to respective knife unit for connecting respective lifting knives to the respective knife unit, a respective lifting knife being fixedly connected to a respective retainer.

6. A shedding device according to claim 5, further comprising a guidance device attached to the frame for guiding the lifting knife a least at the ends of thereof.

7. A shedding device for weaving machines, comprising:

a frame;

two pairs of knife units supported on the frame and movable up and down in mutually opposite directions;

lifting knives arranged on both sides of respective knife units for joint displacement therewith;

crank mechanisms provided at both ends of the respective pairs of knife units for displacing same, together with respective lifting knives; and means for pivotally but positionally stably connecting each knife unit with the frame;

wherein the positively stably and pivotally connecting means comprises a separate lever extending transverse to a displacement direction of the knife unit and arranged on one side of the knife unit and a lever arrangement arranged on another side of the knife unit, the lever arrangement comprising a lever extending transverse to the displacement direction of the knife unit and a guide rod for connecting the lever of the lever arrangement with one of the frame and the knife unit.

8. A shedding device according to claim 7, wherein the lever of the lever arrangement is positively stably connected to the frame, and the guide rod is pivotally connected, at two ends thereof, to the knife unit and the lever of the lever arrangement, respectively.

9. A shedding device according to claim 7, wherein the crank mechanisms are allocated in pairs to a pair of knife units and are disposed on shafts at both ends of the pair of the knife units, the device further comprising a drive wheel mounted on each shaft, and kinematic means for connecting the drive wheels of two shafts for simultaneously driving the drive wheels for effecting synchronous driving of the crank mechanisms.

* * * * *

UNITED STATES PATENT AND TRADEMARK OFFICE

CERTIFICATE OF CORRECTION

PATENT NO. : 5,513,676

DATED : May 7, 1996

INVENTOR(S) : Francisco Speich

It is certified that error appears in the above-identified patent and that said Letters Patent is hereby corrected as shown below:

On the title page, item [73] Assignee: should read -- Textilma AG., Hergiswil, Switzerland--.

Signed and Sealed this

Sixteenth Day of July, 1996

*Attest:*

Bruce Lehman

BRUCE LEHMAN

*Attesting Officer*

*Commissioner of Patents and Trademarks*